US007658090B2

(12) United States Patent
Oetlinger

(10) Patent No.: US 7,658,090 B2
(45) Date of Patent: Feb. 9, 2010

(54) GRID BENDING MACHINE

(75) Inventor: Frank E. Oetlinger, Grafton, WI (US)

(73) Assignee: Blanking Systems, Inc., Grafton, WI (US)

( * ) Notice: Subject to any disclaimer, the term of this patent is extended or adjusted under 35 U.S.C. 154(b) by 545 days.

(21) Appl. No.: 11/530,283

(22) Filed: Sep. 8, 2006

(65) Prior Publication Data

US 2007/0056342 A1 Mar. 15, 2007

Related U.S. Application Data

(60) Provisional application No. 60/715,784, filed on Sep. 9, 2005.

(51) Int. Cl.
*B21D 7/08* (2006.01)

(52) U.S. Cl. ..... 72/389.2; 72/389.3; 72/389.7

(58) Field of Classification Search ..... 72/389.1, 72/389.2, 389.4, 389.6, 389.7, 453.01, 414
See application file for complete search history.

(56) References Cited

U.S. PATENT DOCUMENTS 3,209,577 A * 10/1965 Teplow ..... 72/389.6
3,918,286 A * 11/1975 Whitehead ..... 72/389.8
4,004,445 A * 1/1977 Larson ..... 72/389.8
4,254,651 A * 3/1981 Kelly ..... 72/389.6
4,485,664 A * 12/1984 Richards ..... 72/386
4,638,665 A * 1/1987 Benson et al. ..... 72/389.8
5,528,921 A * 6/1996 Herman ..... 72/389.1
6,128,942 A * 10/2000 Stevicks ..... 72/389.1

* cited by examiner

*Primary Examiner*—David B Jones
(74) *Attorney, Agent, or Firm*—Boyle Fredrickson, S.C.

(57) ABSTRACT

A grid bending machine is provided for bending a workpiece. The machine includes first and second guides having inner surfaces defining a cavity therebetween. A stationary anvil is mounted to the first and second guides. A first die is releaseably connected to the stationary anvil. A body is disposed in the cavity and is movable between a first position release position and a second bending position. A second die is releaseably connected to the body and is aligned with the first die. The second die is axially spaced from the first die with the body in the release position and is adjacent the first die with the body in the bending position.

18 Claims, 5 Drawing Sheets

GRID BENDING MACHINE

CROSS-REFERENCE TO RELATED APPLICATIONS

This application claims the benefit of U.S. Provisional Application Ser. No. 60/715,784, filed Sep. 9, 2005.

FIELD OF THE INVENTION

This invention relates generally to blanking tool grids, and in particular, to a grid bending machine that bends a workpiece with a high degree of accuracy and precision.

BACKGROUND OF THE INVENTION

In a die cutting machine, the blanks are cut, but not removed from a large sheet of paper material. After the blanks have been cut, the sheet is moved downstream in the die cutting machine to a blanking station where the sheet is positioned over a frame assembly for support. The frame assembly includes an outer frame and an inner grid having large openings that correspond in size, in shape and in position to the profile of the carton blank previously cut. Below the frame is a mechanism for stacking the carton blanks.

At the blanking station, an upper tool is used in combination with the lower tool or frame assembly to knock the carton blanks from the sheet of paper material while holding the scrap material that surrounds the blanks. The upper tool has a support board that moves vertically up and down in the die cutting machine, and the support board typically has a plurality of stand-offs depending therefrom that hold pushers spaced beneath the board which in turn are used to push the carton blanks from the sheet through the lower tool or frame assembly. A plurality of presser assemblies are also mounted in the support board and depend therefrom to hold the scrap material against the lower tool or frame assembly during the blanking operation so that the blanks may be pushed from the sheet. A presser assembly typically includes a presser rail that is biased downwardly away from the support board by a spring so that the rail is positioned slightly below the pushers. As the upper tool is lowered, the presser rail engages the sheet of paper material first such that a scrap portion of the large sheet of material is secured between the presser rail and the frame. The upper tool then continues to be lowered such that the sheet of material engages an inner grid within the frame while at substantially the same time the pushers engage the carton blanks and knock the blanks out of the sheet of material and through the inner grid. The carton blanks then fall into a stacking mechanism below the frame where the blanks are stacked for further processing.

The inner grid is typically comprised of a plurality of lengthwise and crosswise extending bars. It can be appreciated that the inner grid must be accurately and precisely formed in order to insure the proper operation of the blanking tool assembly. Heretofore, an inner grid member was formed by placing a workpiece between upper and lower dies. A force is exerted on the workpiece thereby causing the workpiece to bend and conform to the shape of the dies. The process is repeated until the a desired inner grid member is formed. While functional, it has been found that this prior fabrication method lacks the precision needed to properly form the inner grid members. Consequently, it is highly desirable to provided a device and method of fabricating an inner grid member of a blanking tool assembly the is more accurate and precise than prior fabrication methods.

Therefore, it is a primary object and feature of the present invention to provide a grid bending machine that bends a workpiece with a high degree of accuracy and precision.

It is a further object and feature of the present invention to provide a grid bending machine that allows for the quick and easy replacement of the dies used to bend a workpiece.

It is a still further object and feature of the present invention to provide a grid bending machine that is simple to utilize.

In accordance with the present invention, a grid bending machine is provided for bending a workpiece. The machine includes first and second guide walls defining a cavity therebetween. A first die releaseably connected to at least one of the guide walls. A body is slidably received in the cavity. The body is movable between a first position release position and a second bending position. A second die is releaseably connected to the body and aligned with the first die. The second die is axially spaced from the first die with the body in the release position and is adjacent the first die with the body in the bending position.

A quick release mechanism may be used for interconnecting the first die to the at least one of the guide walls. A first cylinder is operatively connected to the body for moving the body from the bending position to the release position. A hydraulic actuator is operatively connected to the body for moving the body from the release position to the bending position. A stop member defines the position of hydraulic actuator with the body in the bending position. A drive mechanism is operatively connected to the stop member. The drive member positions the stop member at a user desired position.

A bearing plate interconnects the first and second guide walls and has an upper surface directed toward the cavity. A first plurality of bearings is disposed between the first guide wall and the body and a second plurality of bearings is disposed between the second guide wall and the body. The first and second plurality of bearings facilitate the movement of the body between the release and bending positions.

In accordance with a further aspect of the present invention, a grid bending machine is provided for bending a workpiece. The machine includes a stationary anvil and a first die releaseably connected to the stationary anvil. A body is movable between a first position release position and a second bending position. A second die is releaseably connected to the body and aligned with the first die. The second die is axially spaced from the first die with the body in the release position and is adjacent the first die with the body in the bending position.

The grid bending machine also includes first and second guide walls defining a cavity therebetween for receiving the body. A bearing plate interconnects the first and second guide walls and has an upper surface directed toward the cavity. A first plurality of bearings is disposed between the first guide wall and the body and a second plurality of bearings is disposed between the second guide wall and the body. The first and second plurality of bearings facilitates the movement of the body between the release and bending positions.

A first cylinder is operatively connected to the body for moving the body from the bending position to the release position. A hydraulic actuator is operatively connected to the body for moving the body from the release position to the bending position. A stop member defines the position of hydraulic actuator with the body in the bending position. A drive mechanism is operatively connected to the stop member. The drive member positions the stop member at a user desired position.

In accordance with a still further aspect of the present invention, a grid bending machine is provided for bending a workpiece. The machine includes first and second guides having inner surfaces defining a cavity therebetween. A stationary anvil is mounted to the first and second guides. A first die is releaseably connected to the stationary anvil. A body is disposed in the cavity and is movable between a first position release position and a second bending position. A second die is releaseably connected to the body and is aligned with the first die. The second die is axially spaced from the first die with the body in the release position and is adjacent the first die with the body in the bending position. A stop member defines the bending position of the body. A drive mechanism is operatively connected to the stop member for positioning the stop member at a user selected position.

A bearing plate interconnects the first and second guide walls and has an upper surface directed toward the cavity. A first plurality of bearings is disposed between the first guide wall and the body and a second plurality of bearings is disposed between the second guide wall and the body. The first and second plurality of bearings facilitate the movement of the body between the release and bending positions.

A first cylinder is operatively connected to the body for moving the body from the bending position to the release position. A hydraulic actuator is operatively connected to the body for moving the body from the release position to the bending position. The hydraulic actuator includes a piston. A portion of the piston engages the stop member with the body in the release position.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
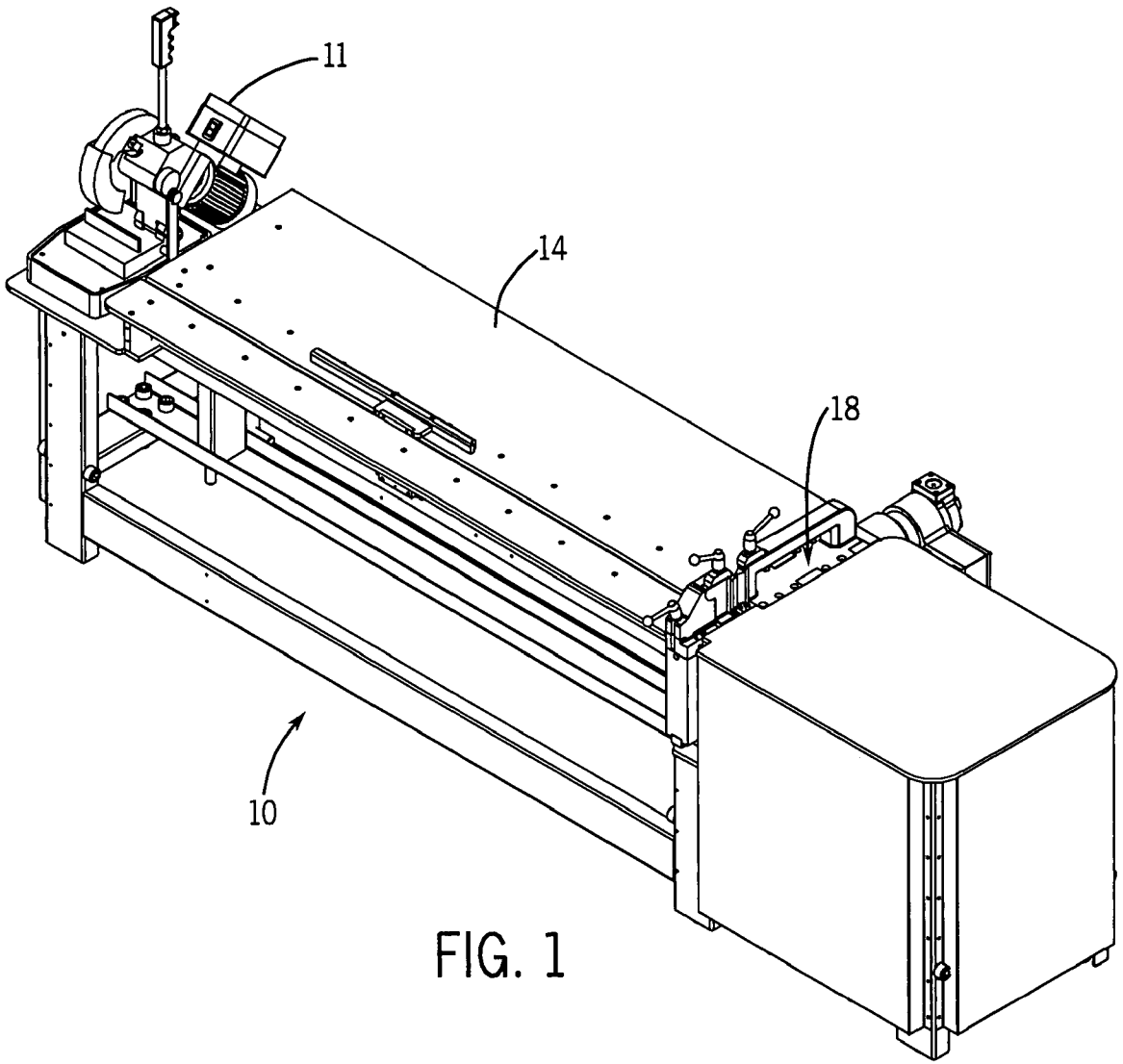
FIG. 1 is an isometric view of the grid member fabrication station incorporating a grid bending machine in accordance with the present invention.

Referring to FIG. 1, a grid member fabrication station is generally designed by the reference numeral 10. Station 10 includes cutter 11 for cutting workpiece 12 to a desired length from a length of stock material. Workpiece 12 supported by table 14 and fed between stationary and movable dies 59 and 92, respectively, of grid bending machine 18. It is intended for grid bending machine 10 to bend workpiece 12, FIG. 4, into an inner grid element for a blanking tool assembly of a carton die cutting machine. However, it can be appreciated that grid bending machine 18 may be used to fabricate other components without deviating from the scope of the present invention. A bending table is provided to receive the inner grid element thereon as it is fabricated.

Figure 2:
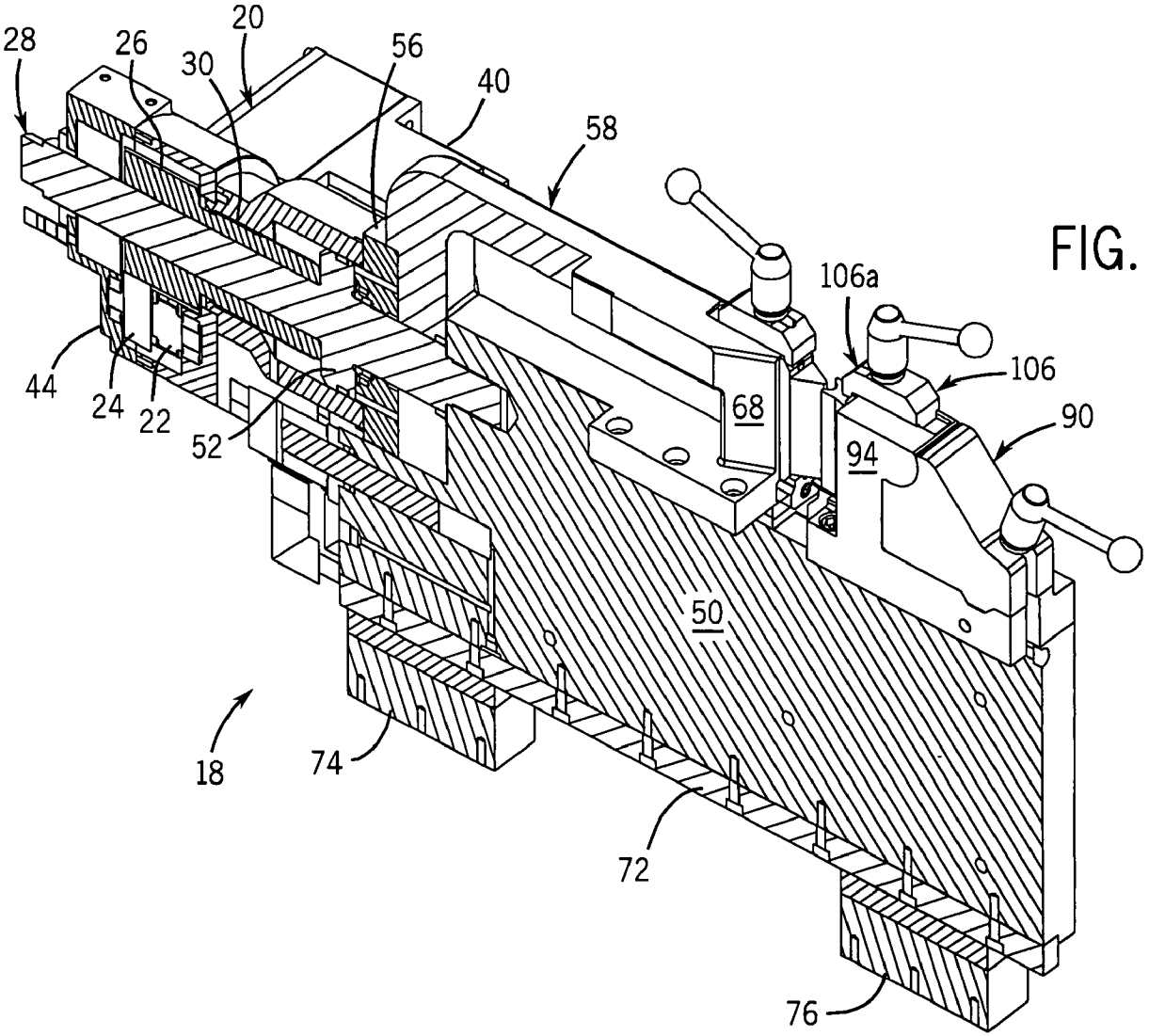
FIG. 2 is an isometric view of a cross section of the grid bending machine of FIG. 1.
Figure 3:
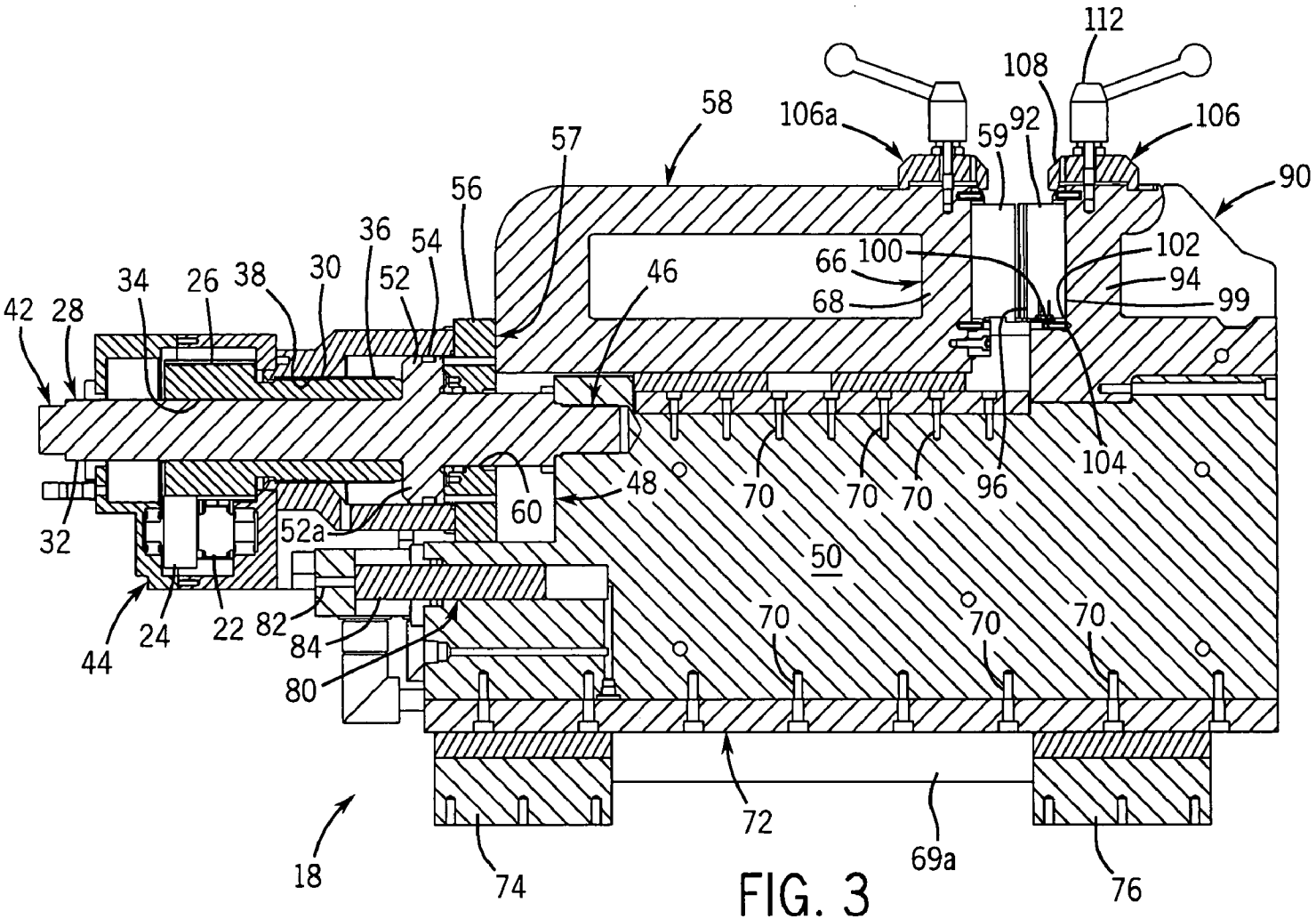
FIG. 3 is a cross sectional view of the grid bending machine of the present invention taken along line 3-3 of FIG. 1.
Figure 4:
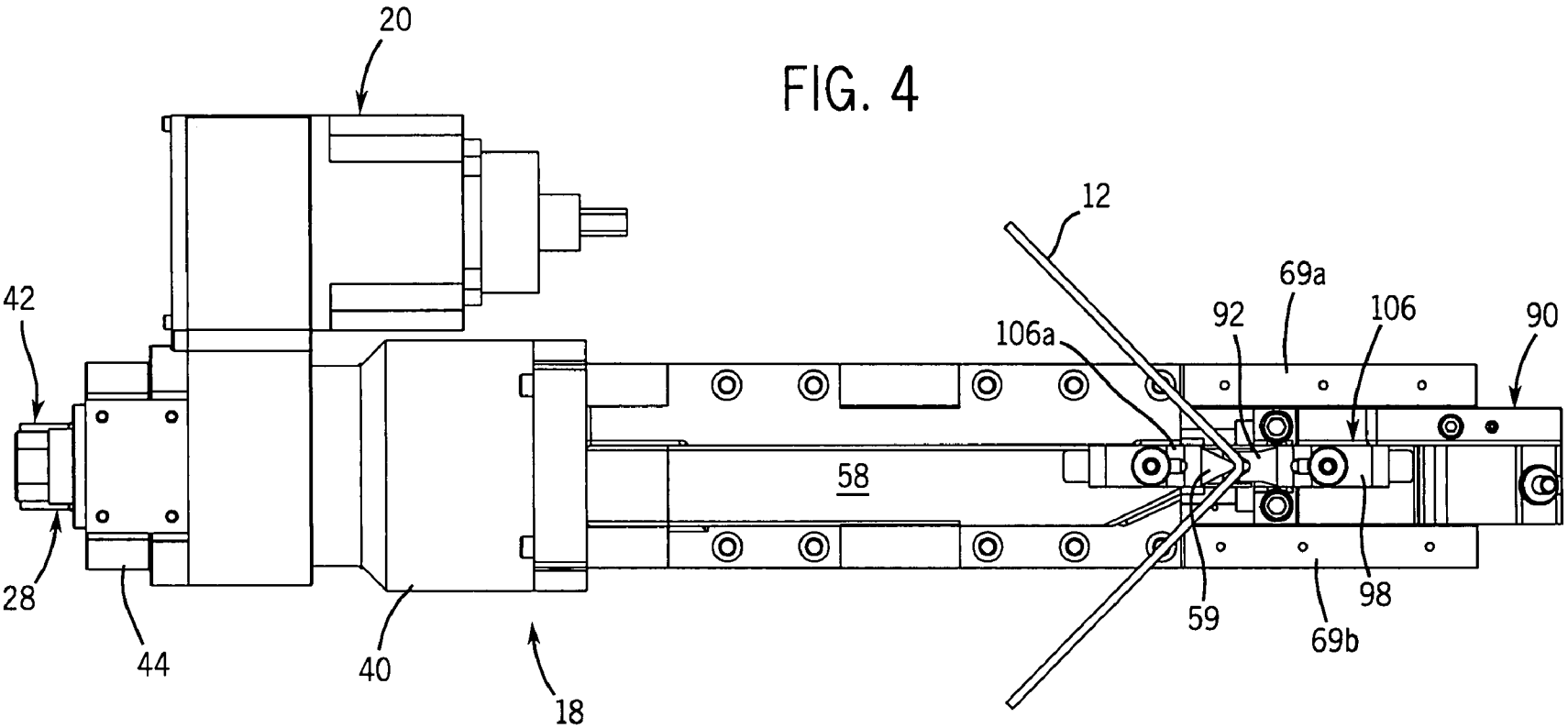
FIG. 4 is a top elevational view of the grid bending machine of the present invention.

Referring to FIGS. 2-4, grid bending machine 18 includes reversible servo-motor 20 operatively connected to a drive pulley (not shown). Drive pulley is coupled to driven pulley 22 by a belt (not shown). Driven pulley 22 is coupled to first gear 24 for rotation therewith. First gear 24 meshes shaft gear 26 rotatably supported on piston shaft 28. Shaft gear 26 includes a generally cylindrical stop screw 30 projecting from a first side of thereof. Stop screw 30 includes inner surface 34 that forms a rotational interface with outer surface 32 of piston shaft 28 and a thread outer surface 36. The threads along outer surface 36 of stop screw 30 mesh with threads along a first portion of inner surface 38 of cylinder housing 40.

Piston shaft 28 includes a first free end 42 extending though a closed end of gear housing 44 and a second end 46 rigidly connected to a first end 48 of slidable body 50. Piston shaft 28 also includes flange 52 extending radially from outer surface 32 thereof. Radially outer edge 52*a* of flange 52 forms a slidable interface with a second portion of inner surface 38 of cylinder housing 40. Seal 54 is provided in radially outer edge 52*a* of flange 52 to prevent the flow of fluid therepast.

Receiver plate 56 interconnects cylinder housing 40 to first end 57 of stationary anvil 58. Receiver plate 56 has inner surface 60 defining a passageway for allowing piston shaft 28 therethough. Bearings 64 are provided in inner surface 60 of receiver plate 56 to facilitate axial movement of piston shaft therethrough. An aperture extends through receiver plate 56 so as to allow the interior of cylinder housing 40 between flange 52 and receiver plate 56 to communicate with a hydraulic fluid source. The pressure of the hydraulic fluid provided by the hydraulic fluid source is intended to move piston shaft 28, and hence body 50, from right to left in FIG. 3, for reasons hereinafter described.

Stationary anvil 58 includes second end 66 incorporating a die connection structure generally designated by the reference numeral 68 that is adapted for receiving a first die 59 of a die pair. It is contemplated to buttress die connection structure 68 in any conventional manner to add strength and stability to die connection structure 68. The sides of stationary anvil 58 are positioned on and interconnected to upper edges of side members 69*a* and 69*b*, FIG. 4. Side members 69*a* and 69*b* define a cavity for slidably receiving body 50. Bearings 70 are provided along the inner surfaces of side members 69*a* and 69*b* to facilitate the sliding of body 50 therein. Bearing plate 72 is positioned between the lower ends of the side members to also facilitate the sliding movement of body 50 in the cavity between side members 69*a* and 69*b*. Bearing support blocks 74 and 76 support bearing plate 72 and interconnect side members 69*a* and 69*b*.

Body 50 is operatively connected to gear housing 44 by hydraulic cylinder 80. More specifically, shaft 82 of cylinder 80 is operatively connected to gear housing 44 and cylinder housing 84 of cylinder 80 is connected to body 50. As hereinafter described, cylinder 80 controls movement of body 50 from left to right in FIG. 3. Movable anvil 90 is mounted to upper surface of body 50 and includes a die connection structure 94 adapted for receiving a corresponding second die 92 of the die pair. It is contemplated to buttress die connection structure 94 in any conventional manner to add strength and stability to die connection structure 94. Die connection structure 94 is identical to die connection structure 68, and as such, the following description of die connection structure 94 is understood to described die connection structure 68 as if fully described herein.

Die connection structure 94 includes inner surface 96 having a V-shaped groove 98, FIG. 4, extending along the length thereof. V-shaped groove 98 is adapted for receiving a corresponding V-shaped rib 99 projecting from die 92. In addition, die connection structure 94 includes hooked structure 100 projecting from inner surface 96. Hooked structure 100 defines recess 102 for receiving projection 104 projecting from die 92. As described, in order to mount die 92 within die connection structure 94, die 92 is positioned such that projection 104 is seated in recess 102 and such that V-shaped rib 99 is seated in V-shaped groove 98. Thereafter, clamping element 106 secures die 92 in position. It can be appreciated that a second clamping element 106a is mounted to the upper surface of die connection structure 68 to secure die 59 therein. As such, the following description of clamping element 106 and its function are understood to describe the structure and function of clamping element 106a as if fully described herein.

Clamping element 106 includes a pivotable clamp 108 mounted to upper surface 110 of movable anvil 90. Clamp 108 is pivotable between a first, release position wherein die 92 is free to be insert and withdrawn from die connection structure 94 and a locking position wherein die 92 is fixed within die connection structure 94. Pivotable handle 112 controls the position of clamp 108. More specifically, handle 112 is generally U-shaped and includes first and second legs and a cross leg. Handle 112 overlaps clamp 108 such that the terminal ends of handle 112 are pivotably connected to opposite sides of movable anvil 90. Handle 112 is movable between a first position wherein the cross leg is seated in a groove along the upper surface of clamp 108 thereby urging clamp 108 into its release position and a second position wherein the cross leg is seated in a second groove along the upper surface of clamp 108 thereby maintaining clamp 108 in its locking position. As a result, by moving handle 112 between its first and second positions, die 92 may be inserted, replaced or fixed within die connection structure.

Figure 5:
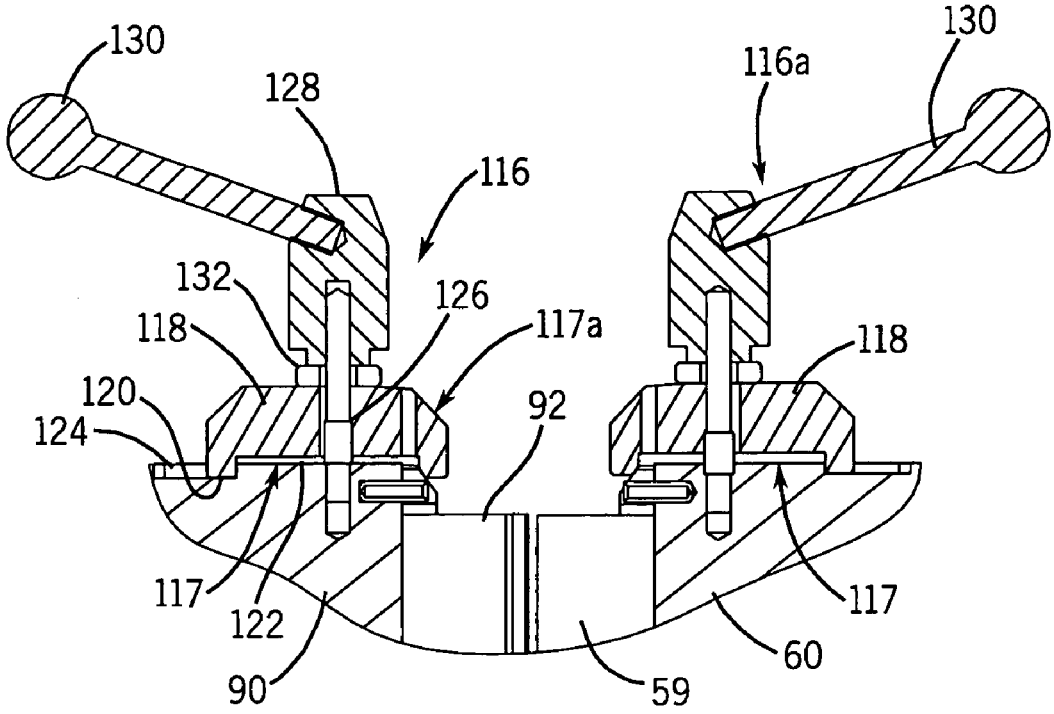
FIG. 5 is a cross sectional view showing an alternate embodiment of the clamping elements for securing dies within the grid bending machine of FIG. 1.

Referring to FIG. 5, an alternate embodiment of a clamping element for station 10 is generally designated by the reference numeral 116. It is intended for clamping element 116 to secure die 92 in position. It can be appreciated that a second clamping element 116*a* may be mounted to the upper surface of die connection structure 68 to secure die 59 therein. The following description of clamping element 116 and its function are understood to describe the structure and function of clamping element 116*a* as if fully described herein.

Clamping element 116 includes clamp 117 having central body 118. First leg 120 depends from lower surface 122 of central body 118 and is seated in recess 124 formed in the upper surface 110 of movable anvil 90. Bolt 126 extends through central body 118 and includes a first end threaded into a bore in upper surface 110 of movable anvil 90. The second end of bolt 126 fixed to header 128 for rotational movement therewith. Handle 130 projects from header 128 so as to allow a user to rotate header 128. Bearing 132 is positioned about bolt 126 and between central body 118 and header 128 to facilitate rotation of header 128. By rotating header 128 with handle 130 in a first direction, bolt 126 is threaded into movable anvil 90, thereby urging end 11 7a of clamp 117 against the upper surface of die 92 so as retain die 92 with die connection structure 94. Alternatively, by rotating header 128 with handle 130 in a second direction, bolt 126 is threaded out of movable anvil 90, thereby drawing end 117a of clamp 117 away from the upper surface of die 92 such that die 92 is free to be inserted and withdrawn from die connection structure 94.

In operation, user desired dies 59 and 92 are positioned within corresponding die connection structures 68 and 94, respectively, as heretofore described. Hydraulic cylinder 80 is actuated so as to slide body 50 from left to right in FIG. 3 such that dies 59 and 92 are separated. Workpiece 12 is positioned at a user desired location between dies 59 and 92. Thereafter, servo-motor 20 is actuated such that the drive pulley rotates driven pulley 22. As a result, first gear 24 coupled to driven pulley 22 rotates shaft gear 26, which in turn, rotates stop screw 30. Stop screw 30 is threaded into cylinder housing 40 such that the terminal end of stop screw 30 defines a limit for movement of body 50 from right to left in FIG. 3. As such, by setting the location of the terminal end of stop screw 30, a user may precisely control the bending angle provided on workpiece 12 by dies 59 and 92.

In order to bend workpiece 12, hydraulic fluid is provided under pressure into the portion of the interior of cylinder housing 40 between flange 52 and receiver plate 56. The pressure of the hydraulic fluid against flange 52 urges piston shaft 28 from left to right in FIG. 3. As piston shaft 28 travels from right to left in FIG. 3, body 50, and hence movable anvil 90, also travels from right to left in FIG. 3 causing die 92 to engage workpiece 12 and bend workpiece 12 about die 59. Piston shaft 28 continues to travel until such point as flange 52 engages the terminal end of stop screw 30. When flange 52 engages the terminal end of stop screw 30, the movement of piston shaft 28, body 50 and movable anvil 90 cease such that the bending of workpiece 12 is terminated. Thereafter, the hydraulic pressure in the portion of the interior of cylinder housing 40 between flange 52 and receiver plate 56 is relieved. Hydraulic cylinder 80 is then actuated so as to slide body 50 from left to right in FIG. 3 so as to separate dies 59 and 92 thereby allowing workpiece 12 to be removed or repositioned between dies 59 and 92 as desired by the user. The process may be repeated thereby allowing a user to precisely form a desired inner grid element for use in a lower blanking tool assembly.

Various modes of carrying out the invention are contemplated as being within the scope of the following claims particularly pointing out and distinctly claiming the subject matter that is regarded as the invention.

I claim:

1. A grid bending machine for bending a workpiece, comprising:

first and second guide walls defining a cavity therebetween;

a first die releaseably connected to at least one of the guide walls and lying on an axis;

a body slidably received in the cavity, the body movable along the axis between a first position release position and a second bending position; and a second die releaseably connected to the body and lying on the axis with the first die, the second die being axially spaced from the first die with the body in the release position and being adjacent the first die with the body in the bending position.

2. The grid bending machine of claim 1 further comprising a quick release mechanism for interconnecting the first die to the at least one of the guide walls.

3. The grid bending machine of claim 1 further comprising a first cylinder operatively connected to the body for moving the body from the bending position to the release position.

4. The grid bending machine of claim 1 further comprising a bearing plate interconnecting the first and second guide walls and having an upper surface directed toward the cavity.

5. The grid bending machine of claim 1 further comprising a first plurality of bearings disposed between the first guide wall and the body and a second plurality of bearings disposed between the second guide wall and the body, the first and second plurality of bearings facilitating the movement of the body between the release and bending positions.

6. A grid bending machine for bending a workpiece, comprising:

a stationary anvil;

a first die releaseably connected to the stationary anvil;

a body movable along an axis between a first position release position and a second bending position; and a second die releaseably connected to the body and lying on the axis with the first die, the second die being axially spaced from the first die with the body in the release position and being adjacent the first die with the body in the bending position.

7. The grid bending machine of claim 6 further comprising first and second guide walls defining a cavity therebetween for receiving the body.

8. The grid bending machine of claim 7 further comprising a bearing plate interconnecting the first and second guide walls and having an upper surface directed toward the cavity.

9. The grid bending machine of claim 7 further comprising a first plurality of bearings disposed between the first guide wall and the body and a second plurality of bearings disposed between the second guide wall and the body, the first and second plurality of bearings facilitating the movement of the body between the release and bending positions.

10. The grid bending machine of claim 7 further comprising a first cylinder operatively connected to the body for moving the body from the bending position to the release position.

11. A grid bending machine for bending a workpiece, comprising:

first and second guides having inner surfaces defining a cavity therebetween;

a stationary anvil mounted to the first and second guides;

a first die releaseably connected to the stationary anvil;

a body disposed in the cavity and being movable between a first position release position and a second bending position;

a second die releaseably connected to the body and aligned with the first die, the second die being axially spaced from the first die with the body in the release position and being adjacent the first die with the body in the bending position;

a stop member defining the bending position of the body; and a drive mechanism operatively connected to the stop member for positioning the stop member at a user selected position.

12. The grid bending machine of claim 11 further comprising a bearing plate interconnecting the first and second guide walls and having an upper surface directed toward the cavity.

13. The grid bending machine of claim 11 further comprising a first plurality of bearings disposed between the first guide wall and the body and a second plurality of bearings disposed between the second guide wall and the body, the first and second plurality of bearings facilitating the movement of the body between the release and bending positions.

14. The grid bending machine of claim 11 further comprising a first cylinder operatively connected to the body for moving the body from the bending position to the release position.

15. The grid bending machine of claim 11 further comprising a hydraulic actuator operatively connected to the body for moving the body from the release position to the bending position.

16. The grid bending machine of claim 15 wherein the hydraulic actuator includes a piston, a portion of the piston engaging the stop member with the body in the release position.

17. A grid bending machine for bending a workpiece, comprising:

first and second guide walls defining a cavity therebetween;

a first die releaseably connected to at least one of the guide walls;

a body slidably received in the cavity, the body movable between a first position release position and a second bending position;

a second die releaseably connected to the body and aligned with the first die, the second die being axially spaced from the first die with the body in the release position and being adjacent the first die with the body in the bending position;

a hydraulic actuator operatively connected to the body for moving the body from the release position to the bending position;

a stop member defining the position of hydraulic actuator with the body in the bending position; and a drive mechanism operatively connected to the stop member, the drive member positioning the stop member at a user desired position.

18. A grid bending machine for bending a workpiece, comprising:

a stationary anvil;

a first die releaseably connected to the stationary anvil;

a body movable between a first position release position and a second bending position;

a second die releaseably connected to the body and aligned with the first die, the second die being axially spaced from the first die with the body in the release position and being adjacent the first die with the body in the bending position;

a hydraulic actuator operatively connected to the body for moving the body from the release position to the bending position;

a stop member defining the position of hydraulic actuator with the body in the bending position; and a drive mechanism operatively connected to the stop member, the drive member positioning the stop member at a user desired position.

* * * * *